US005535961A

United States Patent [19]

Duckworth et al.

[11] Patent Number: 5,535,961

[45] Date of Patent: Jul. 16, 1996

[54] FABRIC SHELL

[75] Inventors: Marty J. Duckworth, Stanley; Ronnie L. Parks, Gastonia; Roger L. Baker, Bessemer, all of N.C.

[73] Assignee: Bridgestone/Firestone, Inc., Akron, Ohio

[21] Appl. No.: 278,531

[22] Filed: Jul. 20, 1994

[51] Int. Cl.[6] ..... B65H 75/10; B65H 75/28

[52] U.S. Cl. ..... 242/586.200; 242/609.2; 242/610.4; 242/613.5; 242/613

[58] Field of Search ..... 242/586.2, 609, 242/609.1, 609.2, 609.3, 609.4, 610.4, 610.6, 613.4, 613.5, 118.31, 118.32, 118.61, 118.62, 118.7, 613

[56] References Cited

U.S. PATENT DOCUMENTS

| | | | |
|---|---|---|---|
| 1,007,418 | 10/1911 | Beecher | 242/610.4 |
| 1,357,345 | 11/1920 | Phelps | 242/613.5 X |
| 1,372,484 | 3/1921 | Cornwall | 242/613.5 X |
| 1,524,483 | 1/1925 | Lowe . | |
| 1,545,661 | 7/1925 | Johnson . | |
| 1,885,789 | 11/1932 | Alderfer . | |
| 2,223,682 | 12/1940 | Gammeter | 242/613.5 |
| 2,953,316 | 9/1960 | Henry . | |
| 3,322,373 | 5/1967 | Wilson, Jr. . | |
| 3,454,235 | 7/1969 | Hurley | 242/613.5 |
| 3,520,490 | 7/1970 | Williams | 242/118.62 |
| 4,021,001 | 5/1977 | Sproat . | |
| 4,103,837 | 8/1978 | Peters . | |
| 4,253,569 | 3/1981 | O'Connor et al. | 242/118.7 |
| 4,919,358 | 4/1990 | Innocenti et al. . | |
| 4,989,802 | 2/1991 | Akao et al. . | |
| 5,149,390 | 9/1992 | Beard et al. | 156/414 |
| 5,174,840 | 12/1992 | Anderson | 156/69 |

*Primary Examiner*—John M. Jillions
*Attorney, Agent, or Firm*—Daniel N. Hall

[57] ABSTRACT

A fabric shell uses a hollow, cylindrical body of polyethylene, which is provided with internal spacers and a urethane foam filling, to support tire cord fabric which is wound about the shell. The outer body of the shell is provided with circumferential grooves that grip the fabric and prevent it from shifting.

4 Claims, 5 Drawing Sheets

FABRIC SHELL

FIELD OF THE INVENTION

The present invention is directed generally to a stock fabric shell. More particularly, the present invention is directed to a tire cord fabric shell. Most specifically, the present invention is directed to a tire cord fabric shell having a polyethylene body and a polyurethane foam filling. The tire cord fabric shell is provided with an exterior axially extending spline groove which aids in the initial securement of an end of the tire cord fabric to the shell at the start of fabric wind-up on the shell. The exterior surface of the shell body is provided with a plurality of generally circumferentially extending grooves or score lines. These score lines allow the tire cord fabric to grip the body of the shell so that there is no lateral or axial shifting of the fabric on the shell.

DESCRIPTION OF THE PRIOR ART

In the production and post production treatment of fabrics, the fabric, in the form of an elongated strip or web, is wound on the surface of a generally cylindrical core or shell. The core or shell supports the elongated web of fabric and also is provided with a central aperture and typically a central tube which is used to support the fabric core or shell on a spindle of a winding machine.

The typical shells which are presently used in the production and treatment of tire cord fabrics have an outer, generally cylindrical surface which is formed of a plurality of axially extending wooden strips or lathes. End caps of metal are placed at the two ends of the cylindrical shell and these end caps have central, rectangular apertures which receive the bar-shaped spindle of the winding machine. Essentially these prior art fabric cores are constructed in a manner generally similar to elongated wooden barrels with metal end caps.

The useful life of a typical, currently used wooden tire cord fabric shell is quite short, generally in the range of three to five trips between a manufacturing plant, or treatment facility and an end user. These wooden tire cord fabric shells deteriorate very quickly and end up in a landfill since they are not easily recyclable. As they deteriorate during use, these wooden cores give off splinters which become entangled in the tire cord fabric and make portions of the fabric wrapped on the core unusable. This unusable fabric is returned to the supplier and must be reprocessed or discarded as scrap.

The prior wooden fabric cord shells are also apt to injure the various workers who may come in contact with them. The wooden bodies of the shells split and generate splinters which may injure the workers. The metal end caps are apt to be deformed during use, or if the shells are dropped, and may end up having rough edges. In addition, the central rectangular apertures in the metal end caps are often deformed by the bar spindles of the winding machines. This deformation again creates sharp edges and may result in the winding spindle turning with respect to the shell.

Prior art wooden fabric cord shells, since they are made with a wooden surface which is somewhat porous, are subject to changes in dimension with changes in weather. This means that a shell which was wrapped with fabric while the shell was in a swelled state due to high relative humidity, may shrink or contract in a dry environment so that the fabric wound on the shell will slip or slide. In addition, since these prior art shells are made of wood, they have very poor dimensional uniformity. Measurements of a group of such wooden shells, even new shells supplied by their manufacturers, will exhibit a wide range of diameters. This dimensional variation leads to variations in the amount of fabric wound on each shell.

A number of various fabric shells are known in the prior art. These prior art shells use various body and end cap materials. None of these previously known fabric stock shells has met with commercial or industry acceptance or success. The wooden shell, with all of its limitations and problems, remains the device used in the tire cord fabric industry.

It will thus be seen that a need exists for a tire cord fabric shell which overcomes the limitations of the prior art devices. The fabric shell in accordance with the present invention provides such a device and is a significant improvement over the prior art devices.

SUMMARY OF THE INVENTION

It is an object of the present invention to provide a stock fabric shell.

Another object of the present invention is to provide a tire cord fabric shell.

A further object of the present invention is to provide a tire cord fabric shell having a polyethylene body.

Yet another object of the present invention is to provide a tire cord fabric shell having a circumferentially grooved body.

Still a further object of the present invention is to provide a tire cord fabric shell having an expanded foam interior.

Even yet another object of the present invention is to provide a tire cord fabric shell which is dimensionally uniform and stable.

Still even a further object of the present invention is to provide a tire cord fabric shell which has a long life and which will not deteriorate under hard usage.

As will be set forth in detail in the description of the preferred embodiment, which is presented subsequently, the tire cord fabric shell in accordance with the present invention utilizes a polyethylene cylindrical shell and end caps, together with spaced interior polyethylene spacers, a central square steel tube, and a filling of expanded polyurethane foam, to produce a fabric shell which is rugged, durable, dimensionally stable and which has a long life.

The tire cord fabric shell of the present invention utilizes cylindrical polyethylene tubing or conduit as the stock material for its body shell. A plurality of spacers are placed in the tube together with a square drive sleeve or tube. End caps are added and the interior is filled with foam. The shell is mounted on a lathe and is trued longitudinally. This truing operation provides two significant and separate benefits. The truing insures dimensional uniformity from one shell to the next. Each shell has the same outer dimension so that the fabric rolls will be the same. The turning of the shells on the lathe also creates a pattern of generally circumferential grooves on the surface of the shell. These grooves allow the fabric initially being wrapped about the shell to grasp or grip the shell so that there will be no lateral or axial shifting of the fabric on the surface of the shell.

The tire cord fabric shells in accordance with the present invention have great strength and are not subject to deterioration with continued usage. In contrast with the short life span of the prior art wooden shells, the polyethylene shells of the present invention will not warp, splinter, crack or break. They do not generate splinters or rough metal edges.

They exhibit dimensional stability and will not shrink or expand with changes in ambient conditions. The tire cord fabric shell in accordance with the present invention is safe for workers to handle and will not cause any injuries.

The tire cord fabric shells of this invention do not contaminate the fabric which is wrapped around them. They are provided with an elongated spline groove which insures quick and secure attachment of a leading end of a fabric web or strip to the surface of the shell at the start of a fabric wind-up operation. The spline groove holds the end of the fabric in place during unwinding and will not allow the end of the fabric to be prematurely released from the shell.

The weight of the tire cord fabric wrapped on a single shell may exceed 4,000 lbs. The tire cord fabric shells of the present invention have the structural rigidity to be able to handle this amount of weight without any warpage or breakage. There are no reels of fabric returned to the manufacturer because of shell failures or fabric contamination by shell materials. This elimination of returns, by itself, makes the tire cord fabric shell of the present invention far superior to the prior art devices.

It will thus be seen that the tire cord fabric shell in accordance with the present invention overcomes the limitations of the prior art devices. It is a substantial advance in the art.

BRIEF DESCRIPTION OF THE DRAWINGS

While the novel features of the tire cord fabric shell in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENTS

Figure 1:
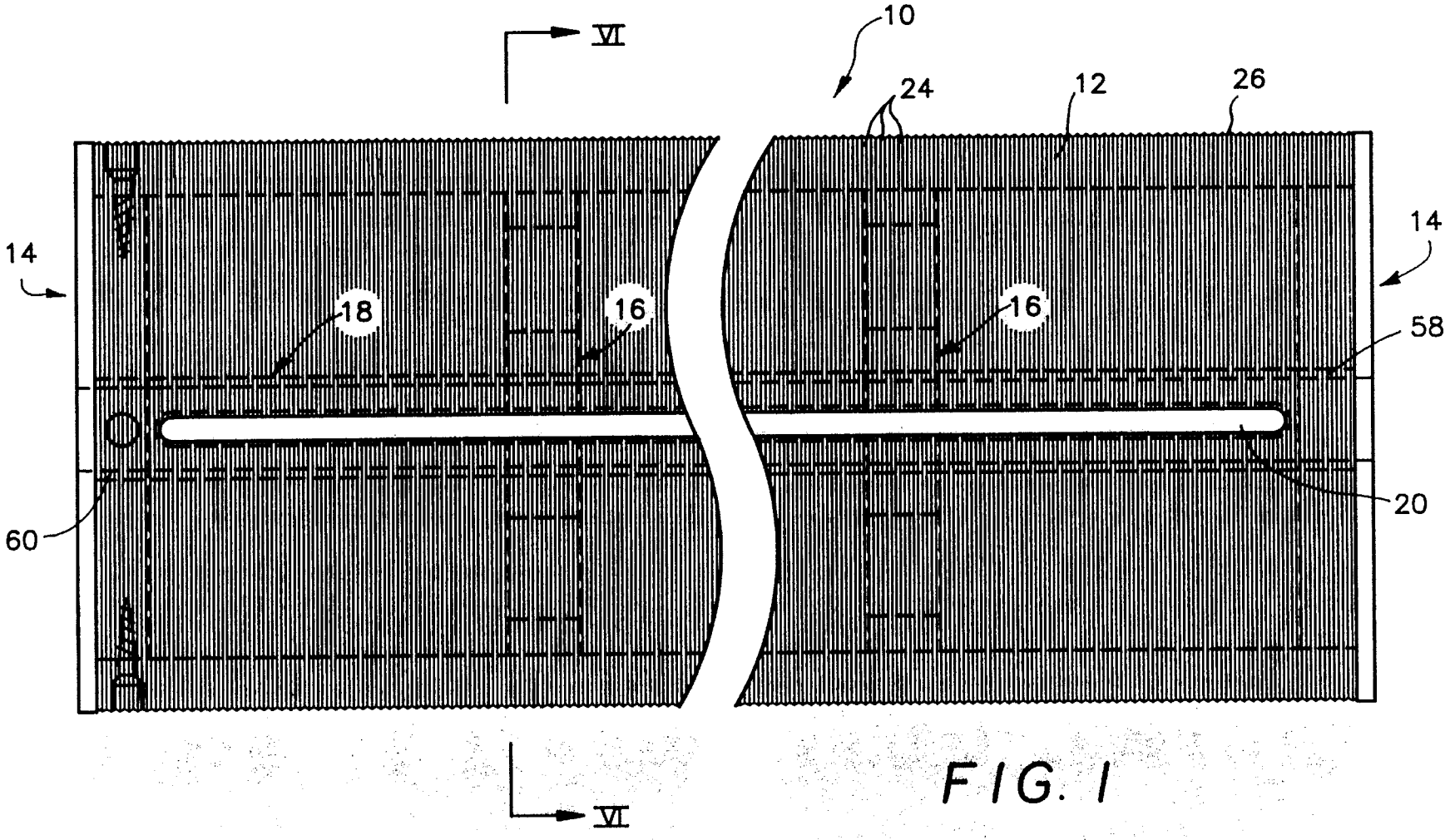
FIG. 1 is a top plan view of a preferred embodiment of a tire cord fabric reel in accordance with the present invention.

Referring initially to FIG. 1, there may be seen, generally at 10, a preferred embodiment of a tire cord fabric shell in accordance with the present invention. The fabric shell 10 in accordance with the present invention is intended for use primarily as a shell or core about which an elongated web of tire cord fabric is to be wound. The shell 10 is positionable upon a spindle of a wind-up machine and is rotated by the wind-up machine to enwrap a typically woven tire cord fabric onto the shell. The use of fabric shells in this manner is generally well known in the art and will not be discussed in detail here. While the fabric shell 10 in accordance with the present invention is intended for use with woven tire cord fabrics, its use is clearly not limited to such fabrics. It can be used with any number of fabrics as a core or shell.

Tire cord fabric shell, generally at 10, has a generally cylindrical, tubular shell body 12 which, in the preferred embodiment is made of a polyethylene material, such as is typically used to form commercial sewer and water lines. In its preferred configuration, the tubular shell body 12 has an outer diameter of 8.250 inches, a wall thickness of 0.625 inches and a length of approximately 62.5 inches. While these dimensions are preferred for the fabric shell 10 when it is used with tire cord fabric, they can change depending on the intended use. The use of polyethylene as the preferred material for the tubular body 12 provides the fabric shell 10 with a strength and a durability which is not provided by other materials. Materials such as PVC have been utilized but have not proven satisfactory. The polyethylene will not deform, warp, splinter or break under the severe usage to which the shell 10 is subjected.

Figure 8:
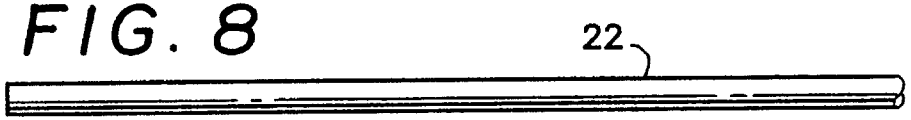
FIG. 8 is a side elevation view of a spline usable in the tire cords fabric shell of the present invention.

An end cap, generally at 14, is used to close each of the two opposite ends of the tubular body 12. A plurality of interior spacers, generally at 16, are positioned in an equally spaced manner, preferably at distances of 15.75 inches on center, along the interior of the tubular body 12. A square hollow steel tube, generally at 18 is supported within the tubular body 12 by the end caps 14 and the interior spacers 16. The remaining interior void space within the tubular body 12 is filled with an expanding urethane foam once the spacers 16, steel tube 18 and end cap 12 have been placed in the tubular body 12. A spline groove 20 is formed in the tubular body 12 and, as will be discussed in detail shortly, is usable with a cooperating spline 22, as shown in FIG. 8, to secure an end of a fabric strip or web to the surface of the tubular body 12.

The tubular body 12 of the fabric shell 10 of the present invention, after the shell has been completely assembled as will be discussed in detail shortly, is subjected to a truing and scoring step by being mounted between centers on a lathe and being turned. This turning operation results in the formation of a plurality of closely spaced, circumferential score lines, depicted somewhat schematically at 24 in FIG. 1, on an outer surface 26 of the tubular body 12. The truing aspect of the turning operation insures that the outer surface 26 of the tubular body 12 has no surface deviations and is straight. The scoring aspect, in which a turning tool, preferably having a 60° v point, is advanced along the length of the tubular body 12 at a feed rate of between 0.012 in to 0.018 inches per revolution, creates the circumferential score lines 24 on the outer surface 26. These score lines, which are depicted only in FIG. 1 for the sake of clarity, provide the fabric shell 10 of the present invention with the ability to grip or grasp the tire cord fabric which will be wound on the shell 10 and to prevent the fabric from shifting laterally on the outer surface 26 of the shell 10.

Figure 3:
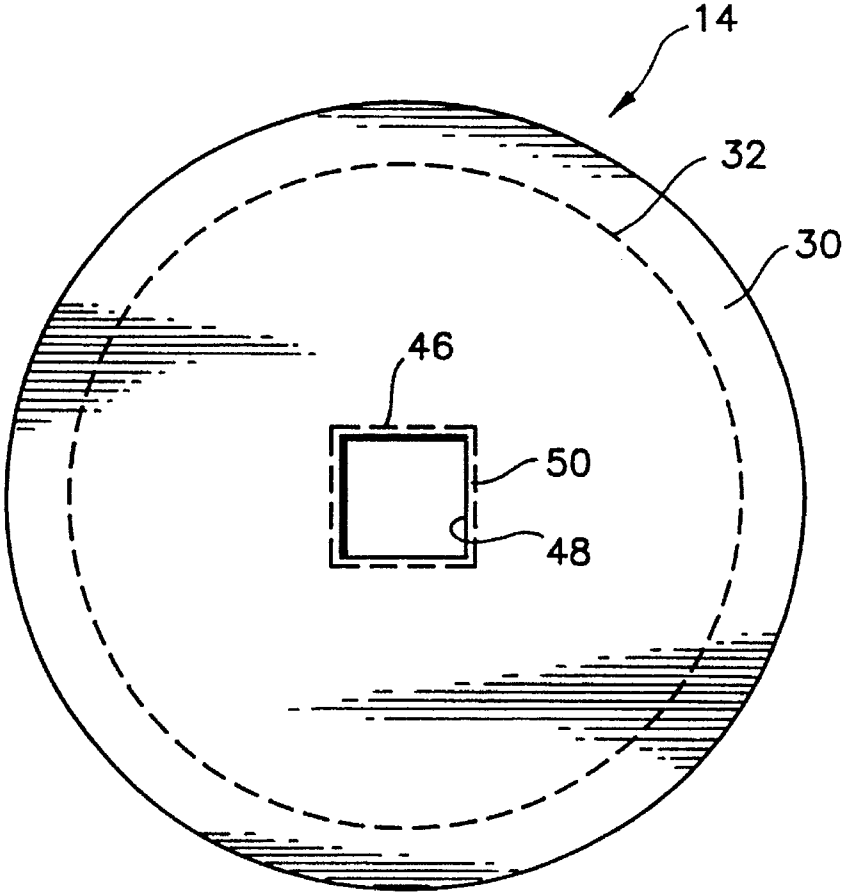
FIG. 3 is an end view of the end cap of FIG. 2.
Figure 2:
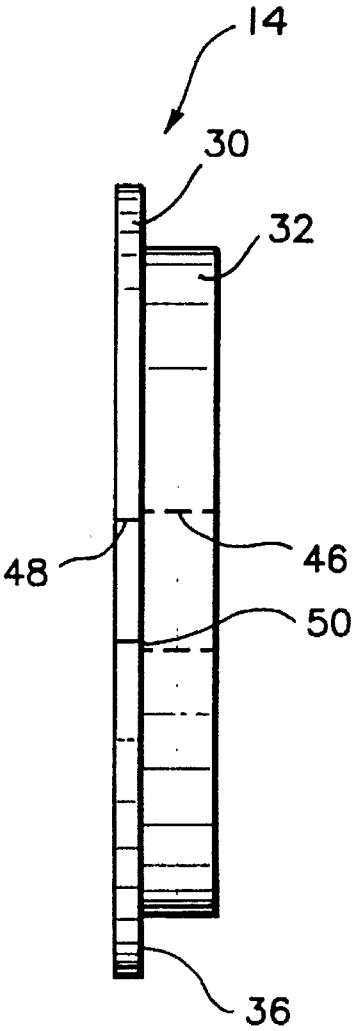
FIG. 2 is a side elevation view of an end cap usable in the tire cord fabric shell.

An end cap, generally at 14, for use in the fabric shell 10 of the present invention, is shown in detail in FIGS. 2 and 3. As may be seen in these two figures, end cap 14 has an enlarged diameter flange 30 and a reduced diameter plug 32. The circumference of the flange 30 is the same as the outer circumference of the tubular body 12, while the circumference of the plug 32 of the end cap 14 is the same as an inner circumference of the tubular body 12. Thus, as is shown more clearly in FIGS. 1 and 7, the end cap 14 is receivable in an end 34 of the tubular body with a vertical inner face 36 of flange 30 abutting an end face 38 of the tubular body 12. A plurality of screws 40 are placed in radially extending bores 42 which are provided at the ends 34 of the tubular body. These screws are secured to the plug portion 32 of the end caps 14 to hold the end caps in place. A suitable plastic filler material 44 is used to fill the bores 42 once the screws are in place.

Figure 7:
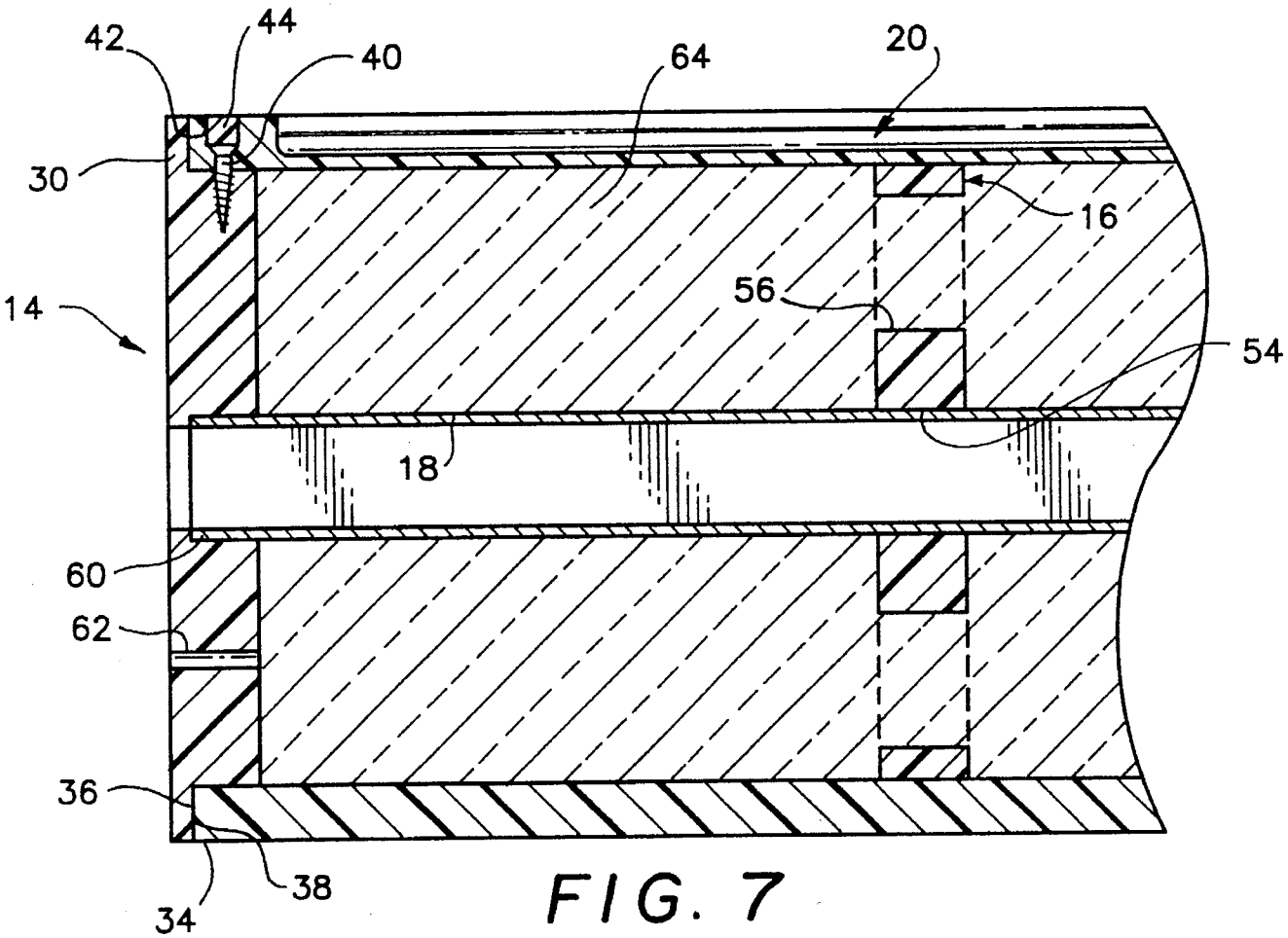
FIG. 7 is a cross-sectional side view of the shell taken along line VII—VII of FIG. 6.

A central rectangular aperture 46 is formed in the plug portion 32 of the end cap. A similar but reduced size aperture 48 is formed in the flange 30. The difference in sizes between the plug aperture 46 and the flange aperture 48 creates a lip or step 50 whose thickness is the same as the wall thickness of the steel tube 18 which, as may be seen most clearly in FIG. 7 is received in the plug aperture 46 but restrained by the lip or step 50 from sliding into the flange aperture 48. When the fabric shell 10 of the present invention is placed in a wind up machine, the generally square spindle of the wind-up machine is received within the hollow steel tube 18. Since the size of the flange aperture 48 is the same as the interior dimensions of the hollow steel tube 18, a wind-up machine spindle will pass through the end caps 14 and the steel tube 18 with no impediment.

Figure 5:
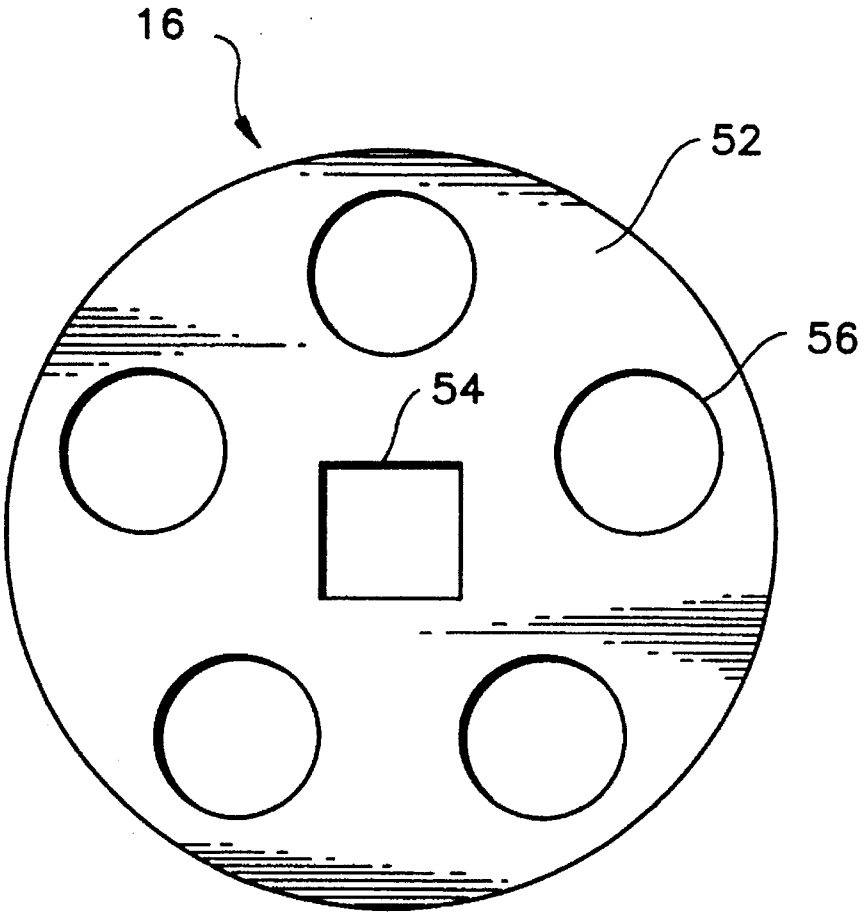
FIG. 5 is an end view of the spacer of FIG. 4.
Figure 4:
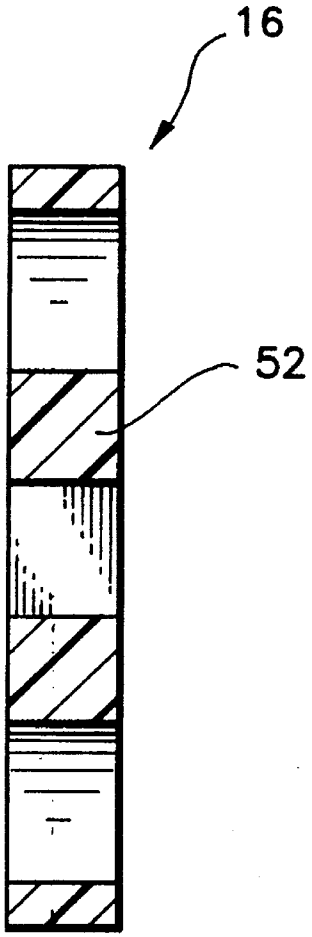
FIG. 4 is a side elevation view of an internal spacer of the tire cord fabric shell.

As was recited briefly in the introductory portion of the description of the preferred embodiment of the fabric shell 10 in accordance with the present invention, a plurality of interior spacers 16 are placed along the steel tube 18 within the interior of the hollow tubular body 12. One such interior spacer 16 is shown in detail in FIGS. 4 and 5. As may be seen in each of these two figures, each interior spacer 16 has a generally disk-shaped body 52 which is provided with a central, generally square aperture 54 and a plurality of circumferentially spaced foam access passages or ports 56. As may be seen most clearly in FIG. 7, the central square aperture 54 is sized to receive the square hollow steel tube 18, while the foam access passages 56 allow free flow of the expandable urethane foam when it is placed in the interior of the hollow tubular body 12, as will be discussed shortly. Each of the interior spacers 16 has an outer circumference that is sized so that the interior spacers will be slidingly receivable within the tubular body 12.

In assemblage of the fabric shell 10 in accordance with the present invention, several interior spacers 16 are slid along the hollow steel tube 18 to their proper locations and can then be secured in place by any suitable means, such as an adhesive, spring clips, small wedges, or the like. One of the end caps 14 is secured to a first end of the tubular body 12 by use of the screws 90 as previously described. The hollow steel tube 18, which in the preferred embodiment is a 12 gauge carbon steel square tubing having an outer height and width of 1.312 inches, together with the several internal spacers 16 which have been positioned along the length of the steel tube 18, are slid into the interior of the tubular body 12 until a first end 58 of the steel tube 18 is received in the plug aperture 46 of the previously secured first end cap 14, which as seen in FIG. 1, is shown as the end cap 14 at the right end of the tubular body 12. As the first end 58 of the steel tube 18 enters the plug aperture 46 in the first end cap 14, the second end cap 14 can be placed on the second end 60 of the steel tube, as shown in FIGS. 1 and 7. The second end cap's plug portion 32 is placed within the end 34 of the tubular body 12 and is secured in place by use of the screws 40, as previously discussed.

As is shown in FIG. 7, each of the end caps 14 of the fabric shell 10 in accordance with the present invention, is provided with a foam fill and vent opening, generally at 62. Once the end caps 14 have been secured in place at the ends of the tubular body 12 and with the hollow steel tube 18 and the internal spacers 16 thereby also in place, a suitable expandable foam, which is depicted in its expanded state at 64 in FIG. 7, is injected into the interior of the hollow tubular body 12 through the foam injection port 62 in one end cap. The air displaced from the entering foam will be discharged through the port 62 in the opposite end cap. The foam access passages 56 in the interior spaces will allow the foam to completely fill all of the void areas in the hollow body 12. Once foam starts to exit through the two foam ports 62 in the end caps, the hollow body 12 of the fabric shell 10 is full of foam and no further injection is necessary. If desired, the two foam injection ports 62 can be filled and sealed in any suitable manner similar to that which is done with the placement of the filler material 44 in the screw head receiving bores 42.

Figure 6:
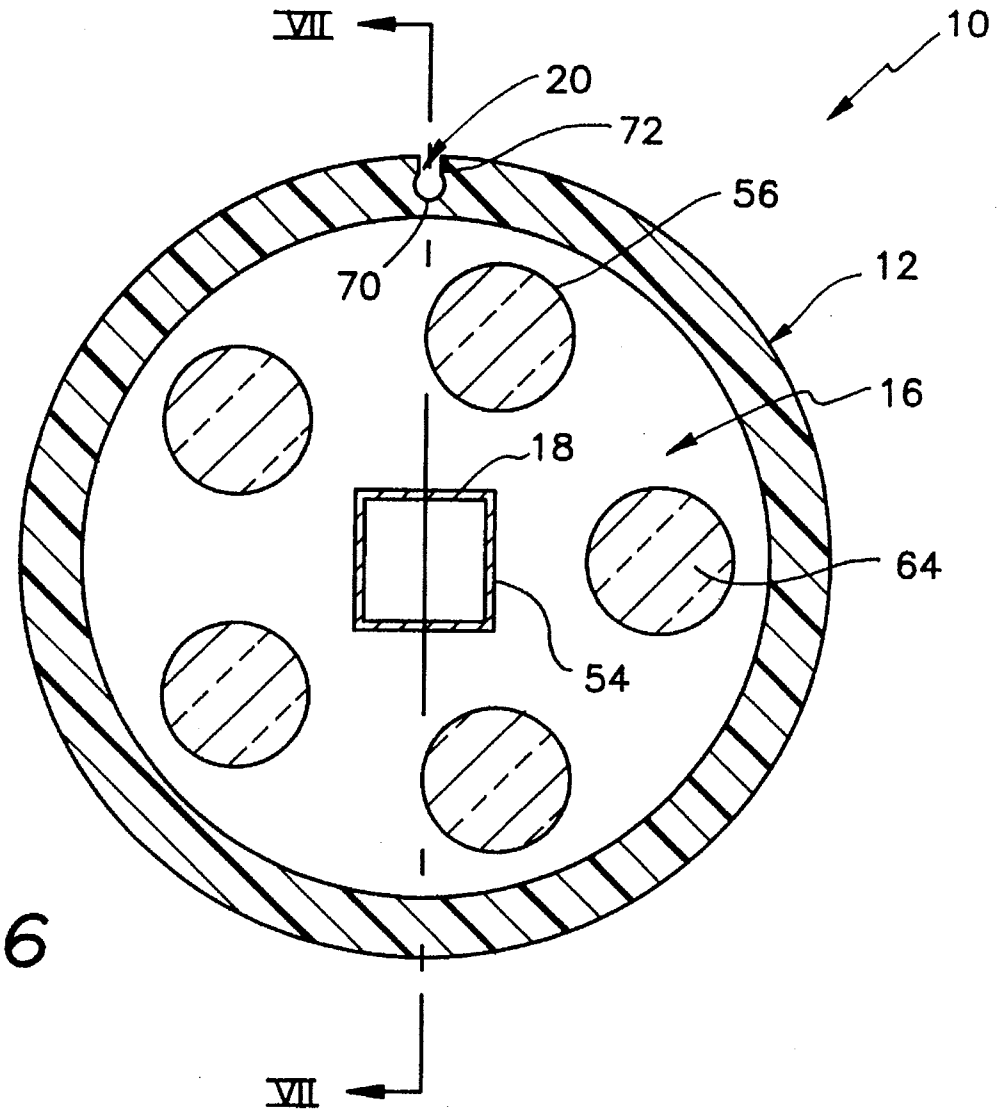
FIG. 6 is a cross-sectional end view of the tire cord fabric shelf taken along line VI—VI of FIG. 1.

Subsequent to the assemblage of the fabric shell 10 and its foam filling, the shell 10 will be placed between centers on a lathe to accomplish the surface truing and scoring, as discussed above. Once the tubular body 12 has been trued and scored, the spline groove generally at 20, as shown in FIGS. 1, 6 and 7 and as has been referred to previously in this discussion, is formed in the tubular body 12 of the fabric shell 10. The spline groove 20 is preferably formed by use of a router bit. As may be seen most clearly in FIG. 6, spline groove 20 has a generally semi-circular bottom 70 and spaced, generally parallel sidewalls 72. The spline groove 20 is used in conjunction with the elongated flexible spline 22, shown in FIG. 8, to attach a leading edge of a tire cord fabric strip or web to the shell 10. The leading edge of the fabric is laid into or across the spline groove 20. The generally cooperatively shaped spline 22 is placed atop the fabric end and above the spline groove 20 and is forced into the spline groove 20 typically by being subjected to several sharp blows with a rubber mallet. The spline groove 20, since it is formed in the durable polyethylene body 12 of the fabric shell 10, will not wear or deteriorate with use. It will function to provide a securement arrangement for the leading edges of fabric strips or webs which allows an operator to quickly, accurately and securely fasten the end of the web to the fabric shell 10. As was discussed previously, once the fabric end is secured to the shell and fabric build-up on the shell is started, the score lines or grooves 24 formed on the outer surface 26 of the tubular body 12 of the fabric shell 10 in accordance with the present invention will securely grip or grasp the fabric and will prevent any lateral shifting of the fabric. The fabric roll build-up on the fabric shell 10 in accordance with the present invention will thereby be straight and true.

The tire cord fabric shell 10 in accordance with the present invention will safely sustain the weight of the fabric being rolled on it. This fabric weight may be in the range of 4,000 lbs. or more. The ability of the tire cord fabric shell 10 to properly handle this weight, which is a function of the structure of the fabric shell 10 and its component ingredients, is essential to the successful operation of the product lines which use this shell. No prior devices have been able to provide the combination of strength, durability, long life, accurate size, fabric hold and overall superiority in performance which is provided by the tire cord fabric shell 10 in accordance with the present invention.

While a preferred embodiment of a tire cord fabric shell in accordance with the present invention has been set forth fully and completely hereinabove, it will be apparent to one of skill in the art that various changes in, for example, the overall length of the shell, the type of wind-up machine which it is used with, the type of fabric being wound on the shell and the like could be made without departing from the true spirit and scope of the present invention which is accordingly to be limited only by the following claims.

What is claimed is:

1. A tire cord fabric shell usable as a core about which a tire cord fabric is windable, said tire cord fabric shell comprising:

a hollow cylindrical tubular body of polyethylene, said tubular body having first and second ends and an outer surface;

a plurality of circumferential score lines formed on said outer surface of said tubular body, said score lines acting to grip a tire cord fabric which is windable about said fabric shell;

end caps receivable in said ends of said tubular body, said end caps each having a central, generally square end cap aperture, said end caps further having plug portions receivable in said first and second ends of said hollow cylindrical tubular body;

an end flange on each of said end caps, said end flange of each of said end caps being in abutting engagement with one of said ends of said tubular body when said plug portion of each of said end caps is received in one of said ends of said tubular body;

fastening means passing through said tubular body and into said plug portions of said end caps to secure said end caps in said ends of said tubular body;

a plurality of spaced interior spacers positioned within said tubular body, each of said spacers having a generally square central aperture and a plurality of circumferentially spaced foam access passages;

a generally square hollow steel tube positioned in said tubular body and supported by said central square apertures in said end caps and interior spacers;

an expanded urethane foam filler in said tubular body, said foam filler filling all void areas within said hollow body; and a spline groove formed in an outer surface of said tubular body and extending axially along said tubular body over substantially the length of said tubular body, said spline groove adapted to receive a spline and being usable to secure a fabric web end to said tubular body.

2. The fabric shell of claim 1 further including an end cap flange aperture in said end flange of each of said end caps, said end cap flange aperture being smaller than said plug aperture in each of said end caps.

3. The fabric shell of claim 1 wherein each of said interior spacers is generally disk-shaped and further wherein said foam access passageways are generally circular bores.

4. The fabric shell of claim 1 wherein said fastening means to secure said end caps in said ends of said tubular body include screw fasteners passing through said tubular body and into said plug portions of said end caps.

* * * * *